US010718581B2

(12) United States Patent
Rieger et al.

(10) Patent No.: US 10,718,581 B2
(45) Date of Patent: Jul. 21, 2020

(54) SELF-LOADING PISTOL

(71) Applicant: UMAREX GmbH & Co. KG, Arnsberg (DE)

(72) Inventors: Daniel Rieger, Willingen (DE); Eyck Pflaumer, Arnsberg (DE); Martin Wonisch, Arnsberg (DE)

(73) Assignee: UMAREX GMBH & CO. KG, Arnsberg (DE)

( * ) Notice: Subject to any disclaimer, the term of this patent is extended or adjusted under 35 U.S.C. 154(b) by 61 days.

(21) Appl. No.: 16/210,636

(22) Filed: Dec. 5, 2018

(65) Prior Publication Data

US 2019/0170462 A1 Jun. 6, 2019

(30) Foreign Application Priority Data

Dec. 5, 2017 (DE) ..... 10 2017 128 911

(51) Int. Cl.

| | |
|---|---|
| ***F41A 9/52*** | (2006.01) |
| ***F41A 17/38*** | (2006.01) |
| ***F41A 19/11*** | (2006.01) |
| ***F41A 9/59*** | (2006.01) |
| ***F41A 9/83*** | (2006.01) |
| *F41C 3/00* | (2006.01) |

(52) U.S. Cl.

CPC ..... *F41A 9/52* (2013.01); *F41A 9/59* (2013.01); *F41A 9/83* (2013.01); *F41A 17/38* (2013.01); *F41A 19/11* (2013.01); *F41C 3/00* (2013.01)

(58) Field of Classification Search

CPC .. F41A 35/00; F41A 9/59; F41A 17/38; F41A 9/52; F41A 9/83; F41A 19/11; F41A 3/00

USPC ..... 42/17

See application file for complete search history.

(56) References Cited

U.S. PATENT DOCUMENTS

| | | | | | |
|---|---|---|---|---|---|
| 3,715,826 | A * | 2/1973 | Seifried | F41A 17/38 | 42/70.06 |
| 4,326,353 | A * | 4/1982 | Ludwig | F41A 35/06 | 42/7 |
| 4,574,509 | A * | 3/1986 | Smith | F41A 35/06 | 42/7 |
| 4,615,134 | A * | 10/1986 | Beretta | F41A 35/06 | 42/6 |
| 4,747,224 | A * | 5/1988 | Smith | F41A 35/06 | 42/7 |

(Continued)

FOREIGN PATENT DOCUMENTS

| | | |
|---|---|---|
| DE | 3327145 A1 | 3/1984 |
| DE | 3439062 A1 | 5/1985 |
| DE | 10353155 A1 | 6/2005 |

*Primary Examiner* — Joshua E Freeman

(74) *Attorney, Agent, or Firm* — Edell, Shapiro & Finnan, LLC

(57) ABSTRACT

A self-loading pistol comprising a magazine shaft which can receive a magazine; a retainer which can hold the magazine releasably in the magazine shaft; and a magazine release which can cause the retainer to release the magazine. The magazine release can be operated from both sides of the self-loading pistol and comprises two release buttons which are arranged on different sides of the self-loading pistol. The magazine release further comprises two release levers which are disposed on different sides of the self-loading pistol. The magazine can be released by actuating either release button and/or by actuating either release lever.

13 Claims, 6 Drawing Sheets

(56) References Cited

U.S. PATENT DOCUMENTS 4,835,892 A * 6/1989 Ruger ..... F41A 35/06 42/7
5,519,954 A * 5/1996 Garrett ..... F41A 17/38 42/6
5,628,134 A * 5/1997 Wesp ..... F41A 17/38 42/50
7,219,462 B2 * 5/2007 Finn ..... F41A 17/38 42/49.01
7,395,747 B2 * 7/2008 Murello ..... F41A 17/40 42/70.01
8,166,691 B1 * 5/2012 Karfiol ..... F41A 35/06 42/6
8,438,768 B2 * 5/2013 Kallio ..... F41A 17/46 42/70.02
8,561,334 B2 * 10/2013 Metzger ..... F41A 17/38 42/49.01
9,651,328 B1 * 5/2017 Oglesby ..... F41A 35/06
2006/0265925 A1 * 11/2006 Murello ..... F41A 17/38 42/70.01
2007/0169390 A1 * 7/2007 Bubits ..... F41A 35/06 42/7
2008/0078284 A1 * 4/2008 Murello ..... F41A 17/36 89/137
2010/0287806 A1 * 11/2010 Marfione ..... F41A 17/38 42/7
2011/0146127 A1 * 6/2011 Metzger ..... F41A 17/38 42/7
2011/0232148 A1 * 9/2011 Cain ..... F41A 17/38 42/6
2014/0325886 A1 11/2014 Mather
2016/0047613 A1 * 2/2016 Hudson, III ..... F41A 3/86 42/14
2016/0069628 A1 * 3/2016 Fluhr ..... F41A 35/06 42/6
2018/0149438 A1 * 5/2018 Headrick ..... F41A 3/72
2018/0156556 A1 * 6/2018 Wyssen ..... F41A 35/06

* cited by examiner

SELF-LOADING PISTOL

TECHNICAL FIELD

The present invention relates to a self-loading pistol in accordance with the preamble of claim 1.

BACKGROUND

A self-loading pistol of the aforementioned type is known from DE 29 05 770 A1. The self-loading pistol, described in said German patent, comprises a grip piece having a magazine shaft for receiving a magazine. The magazine is held by means of a retaining means having a projection, which engages in a recess of the magazine, in the magazine shaft. The projection can be pivoted out of the recess. For this purpose a release button, which the user can actuate with his thumb, is provided on each side of the self-loading pistol. Owing to the provision of two release buttons on the opposite sides of the self-loading pistol, the magazine release means are just as easy to operate by not only a right-handed person, but also by a left-handed person.

The published document DE 195 07 012 A1 discloses an additional self-loading pistol. The self-loading pistol, disclosed in said German patent, comprises a release lever on each side. Said release lever can be pivoted downwards in such a way that, as a result, a projection, which engages in a recess of the magazine, can be pivoted out of said recess, in order to release the magazine. In this context both levers move simultaneously. In this case, too, the result is that it is just as easy for a left-hand person to operate said levers as it is for a right-handed person. Thus, the levers can be actuated, in particular, by the thumb or also by the trigger finger of the shooter.

The problem, on which the present invention is based, is the provision of a self-loading pistol of the aforementioned type that comprises a magazine release means that can provide the shooter with a plethora of operating options.

SUMMARY

The aforementioned object is achieved, according to the invention, by means of a self-loading pistol of the aforementioned type that exhibits the characterizing features disclosed in claim 1. The dependent claims relate to preferred embodiments of the invention.

According to claim 1, it is provided that the magazine release means comprise additionally two release levers, which are disposed on different sides of the self-loading pistol, wherein the magazine can be released by actuating a release button and/or by actuating a release lever. Thus, a self-loading pistol, according to the present invention, offers a release lever and a release button not only for right-handed persons, but also for left-handed persons, so that the shooter himself can decide whether he will release the magazine by a movement of the thumb or the trigger finger.

In this respect it can be provided that the release levers can be actuated and/or moved independently of the release buttons. In particular, any one of the release levers can be actuated and/or moved independently of the respective other release lever. In this way when one release lever is being actuated, all of the other release levers stay in their home position. Even when a release button is actuated, the release levers are not moved. Therefore, this feature is advantageous, in particular, because it prevents the release mechanism from being blocked, for example, by the gun hand below a release lever.

There is the option that, upon actuation, any one of the release levers is pivoted about an axis that extends in the transverse direction of the self-loading pistol, wherein, in particular, any one of the release levers can be freely rotated relative to the axis. As a result of this design, it is possible to achieve with simple means that, upon actuation of one release lever, the other release lever is not moved along with it at the same time.

It can be provided that the release buttons are rigidly connected to one another, in particular, by means of a web that extends in the transverse direction of the self-loading pistol. Such a design can be implemented with simple means and is, therefore, comparatively inexpensive.

There is the option that, upon actuation, any one of the release buttons is displaced in the transverse direction of the self-loading pistol, in particular, into a grip piece comprised by the self-loading pistol.

It can be provided that the retaining means comprise a retaining pawl, which can engage in a recess of the magazine and, in said state extending into the recess, holds the magazine in the magazine shaft.

There is the option that any one of the release levers has a nose, which engages in a recess of the retaining means and, upon actuation of the release lever, moves the retaining means in such a way that the magazine is released, in particular, wherein, upon actuation of the release lever, the retaining means are moved in such a way that the retaining pawl is pivoted out of the recess. In this way it is possible to move the retaining pawl out of the recess by pivoting a release lever about the axis extending in the transverse direction of the self-loading pistol without causing the other release lever to be moved at the same time.

It can be provided that the web, which connects the release buttons, comprises two ramps, along which, upon actuation of a release button, a section of the retaining means slides in such a way that the magazine is released, in particular, wherein, upon actuation of the release button, the retaining pawl is pivoted out of the recess. In this case the two ramps act as a control cam for the movement of the retaining pawl.

There is the option that the magazine release means comprise at least one spring, which can transfer the actuated release lever or the actuated release lever back again into the home position after the magazine has been released.

BRIEF DESCRIPTION OF THE DRAWINGS

Other features and advantages of the present invention shall become apparent from the following description of preferred exemplary embodiments with reference to the accompanying drawings. The drawings show in.

DETAILED DESCRIPTION

Figure 1:
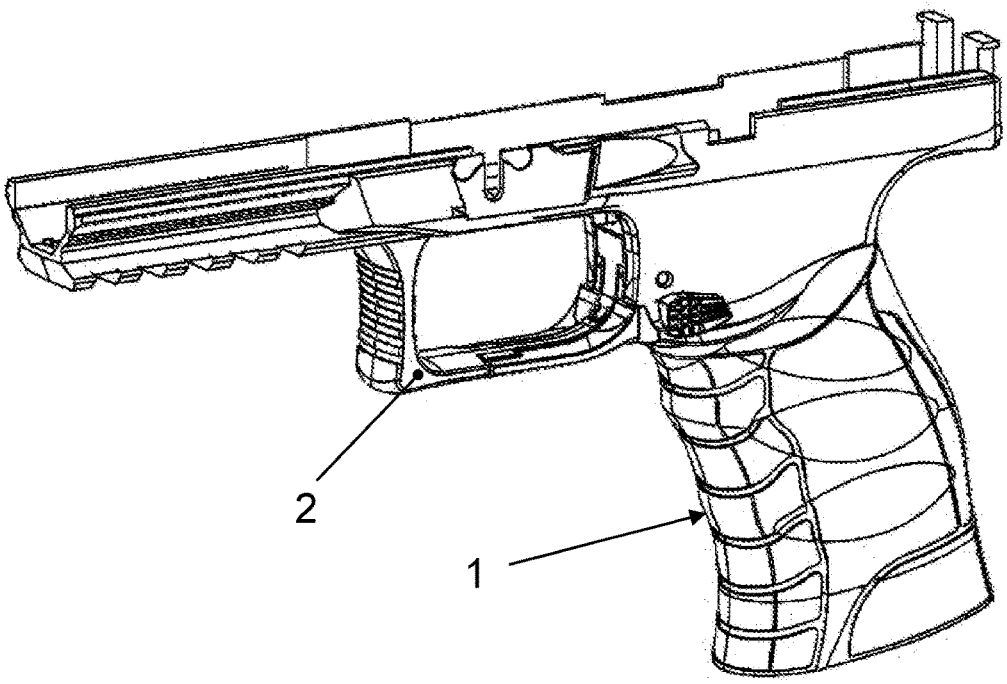
FIG. 1 is a perspective view of a detail of a self-loading pistol according to the present invention.

Identical and functionally identical parts are provided with the same reference numerals in the figures.

Figure 2:
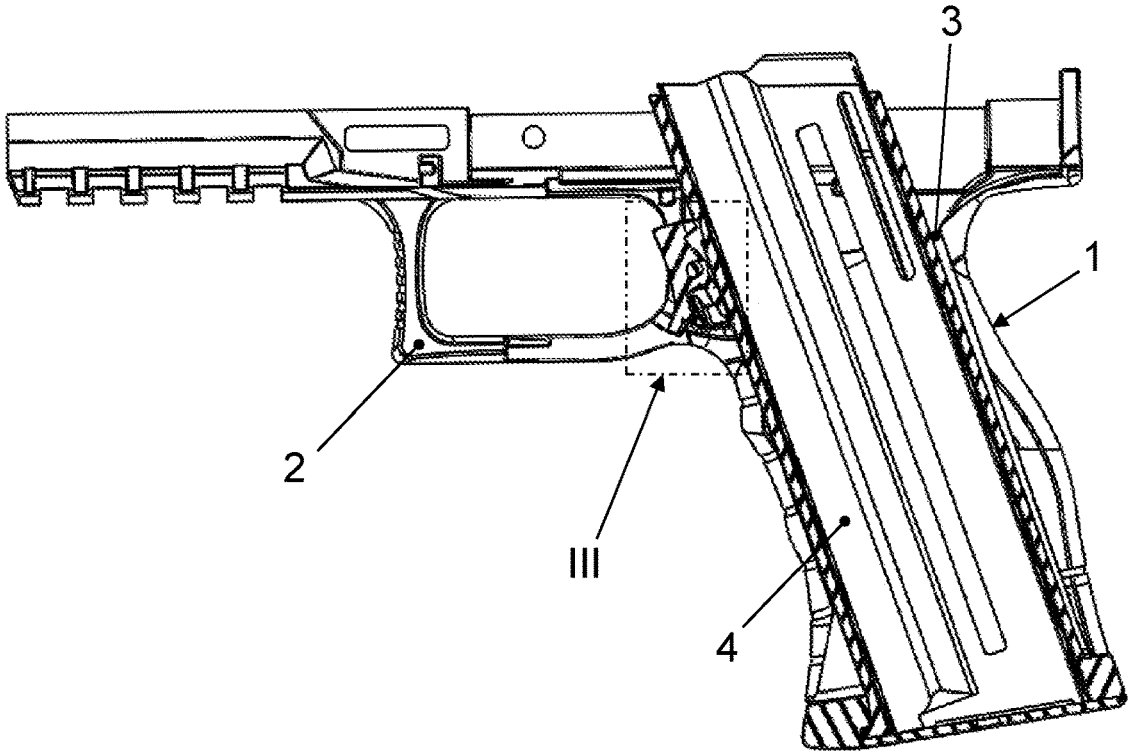
FIG. 2 is a partially cut side view of the self-loading pistol according to FIG. 1.

FIG. 1 and FIG. 2 show a grip piece 1 of a self-loading pistol of the present invention. The grip piece 1 comprises a trigger guard 2 and a magazine shaft 3, in which a magazine 4 is held (see FIG. 2).

Figure 3:
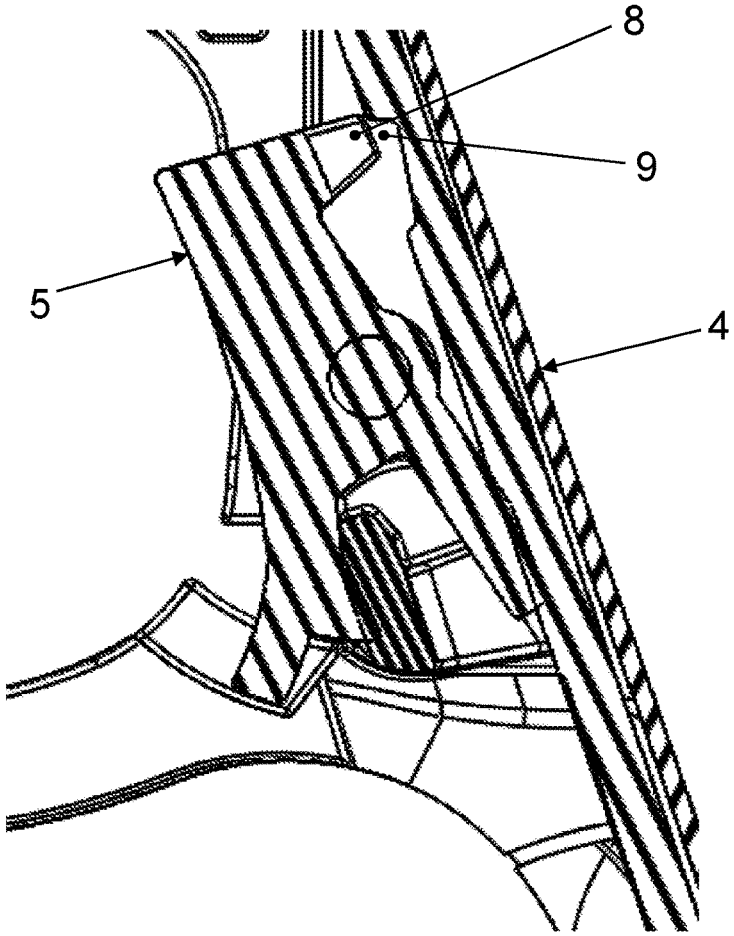
FIG. 3 is a detail according to the arrow III in FIG. 2.

Furthermore, the self-loading pistol comprises retaining means 5, which can hold the magazine 4 in the magazine shaft 3. The retaining means 5 can be moved in the grip piece 1 in a manner allowing rotation about an axis 6, wherein the axis 6 extends in the transverse direction perpendicular to the direction of fire of the self-loading pistol, and the retaining means 5 comprise a cross hole 7 for the axis 6 to extend through. Furthermore, the retaining means 5 comprise a retaining pawl 8, which can engage in a corresponding recess 9 in the magazine 4 (see FIG. 3 and FIG. 4). In this case the retaining pawl 8 is pressed by a spring 10, which is designed as a helical spring in the exemplary embodiment that is shown, into the recess 9.

Furthermore, the self-loading pistol comprises magazine release means that can cause the retaining means 5 to release the magazine 4. The magazine release means comprise two release levers 11, 12, which can be pivoted about the axis 6 and any one of which is arranged on a side of the self-loading pistol (see FIG. 4, FIG. 5 and FIG. 6). The release levers 11, 12 also comprise cross holes 13, 14, through which the axis 6 can extend. Such release levers 11, 12 are also called paddles.

Any one of the release levers 11, 12 comprises an actuating section 15, 16, which extends forwards from the axis 6 in the direction of fire and which the user can press downwards, in particular, with his index finger, in order to release the magazine 4. The release levers 11, 12 can be rotated about the axis 6, so that the actuating sections 15, 16 can be pressed downwards independently of one another.

The trigger guard 2 comprises a recess 17 on each of its transverse sides (see FIG. 7); and one of the actuating sections 15, 16 projects partially into said recess. In this way the corresponding release lever 11, 12 terminates outwards in the transverse direction flush with the trigger guard 2 in the non-actuated state (see, for example, FIG. 6).

Figure 5:
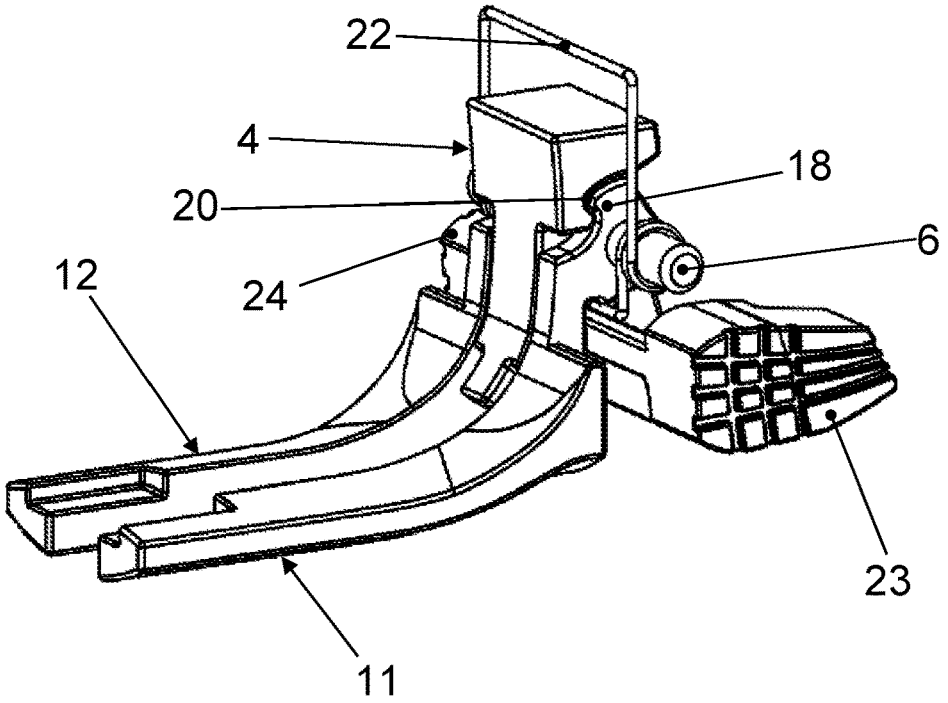
FIG. 5 is a perspective view of the retaining means and the magazine release means in the assembled state.

The release levers 11, 12 comprise noses 18, 19, which engage in corresponding recesses 20 of the retaining means 5 in the assembled state (see for this purpose FIG. 5). A finger touch of the user on one of the actuating sections 15, 16 downwards or, more specifically, in the direction of the arrow 21 in FIG. 10 transfers said actuating section out of the substantially horizontal position (see FIG. 9), in which the actuating section 15, 16 is parallel to the bottom section of the trigger guard 2, into a downwards tilted position (see FIG. 10).

Figure 9:
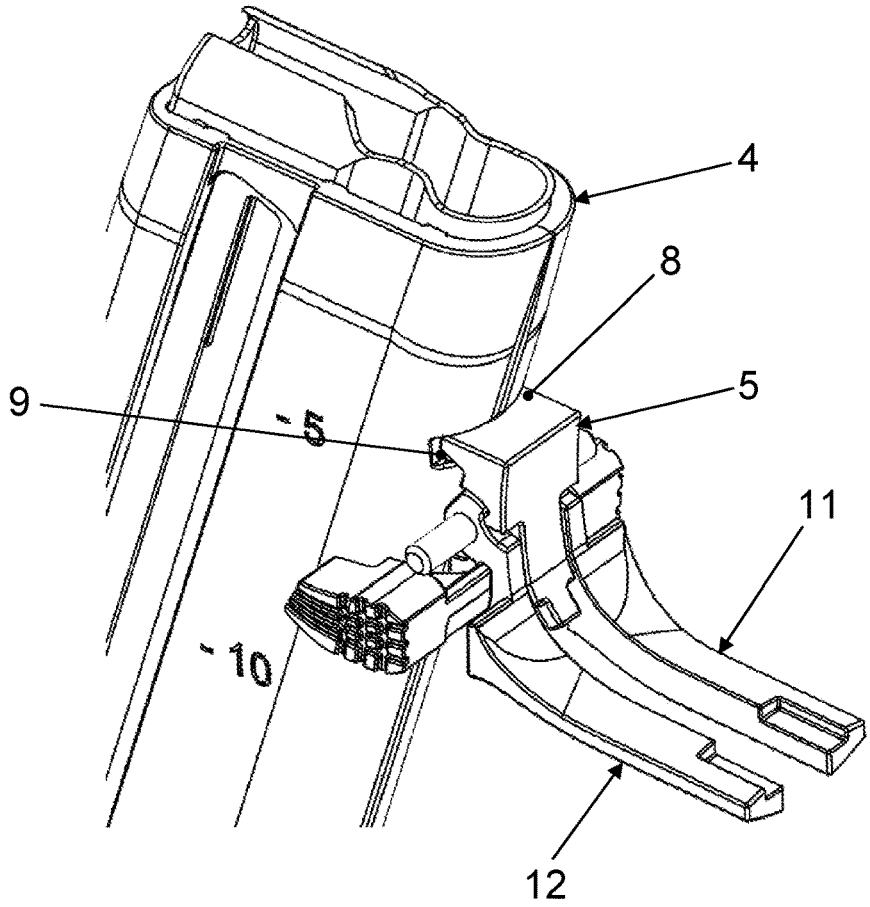
FIG. 9 is a perspective view of the magazine with the retaining means and the magazine release means of the self-loading pistol, according to FIG. 1, with the retaining means holding the magazine.
Figure 10:
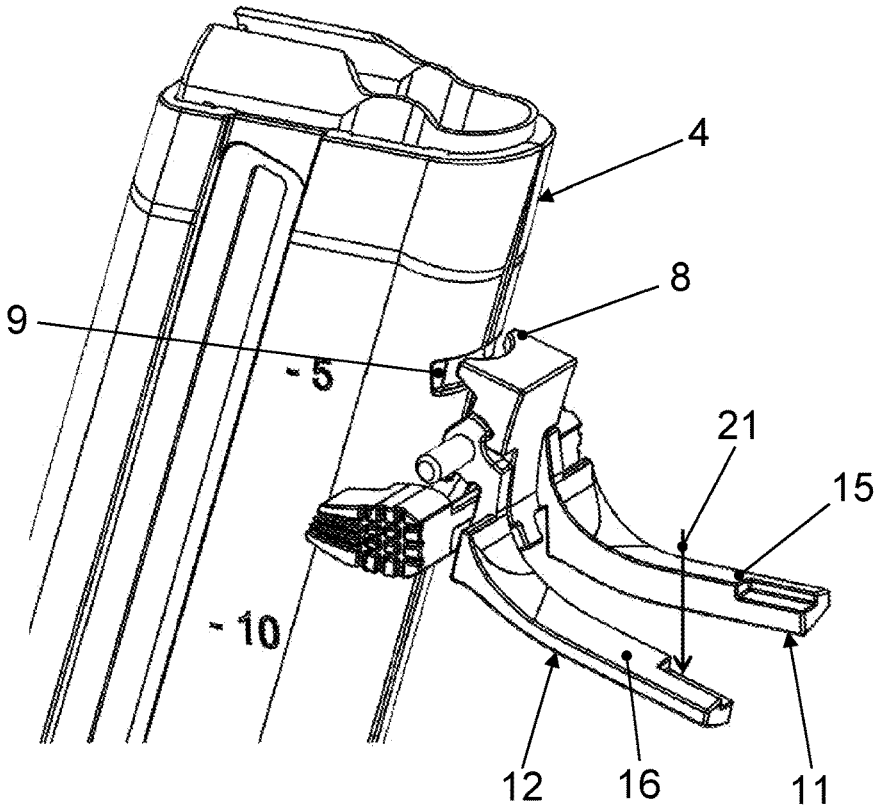
FIG. 10 is a view, which corresponds to FIG. 9 and in which the magazine is released by actuating a release lever.

As a result of this pivoting, for example, of the release lever 12, the corresponding nose 19 presses into the associated recess 20 and pivots the retaining means 5 in such a way that the retaining pawl 8 is moved out of the recess 9 (see the transition from FIG. 9 to FIG. 10). As a result, the magazine 4 is released, so that it can be removed from the magazine shaft 3.

Furthermore, the magazine release means comprise a spring 22, which is designed as a yoke spring in the exemplary embodiment that is shown. In the assembled state this spring is also mounted on the axis 6 (see FIG. 4 and FIG. 5). The spring 22 transfers the pivoted release lever 11, 12 back again into the home position in accordance with FIG. 6 and FIG. 9, when the user has released the actuating section 15, 16.

Figure 4:
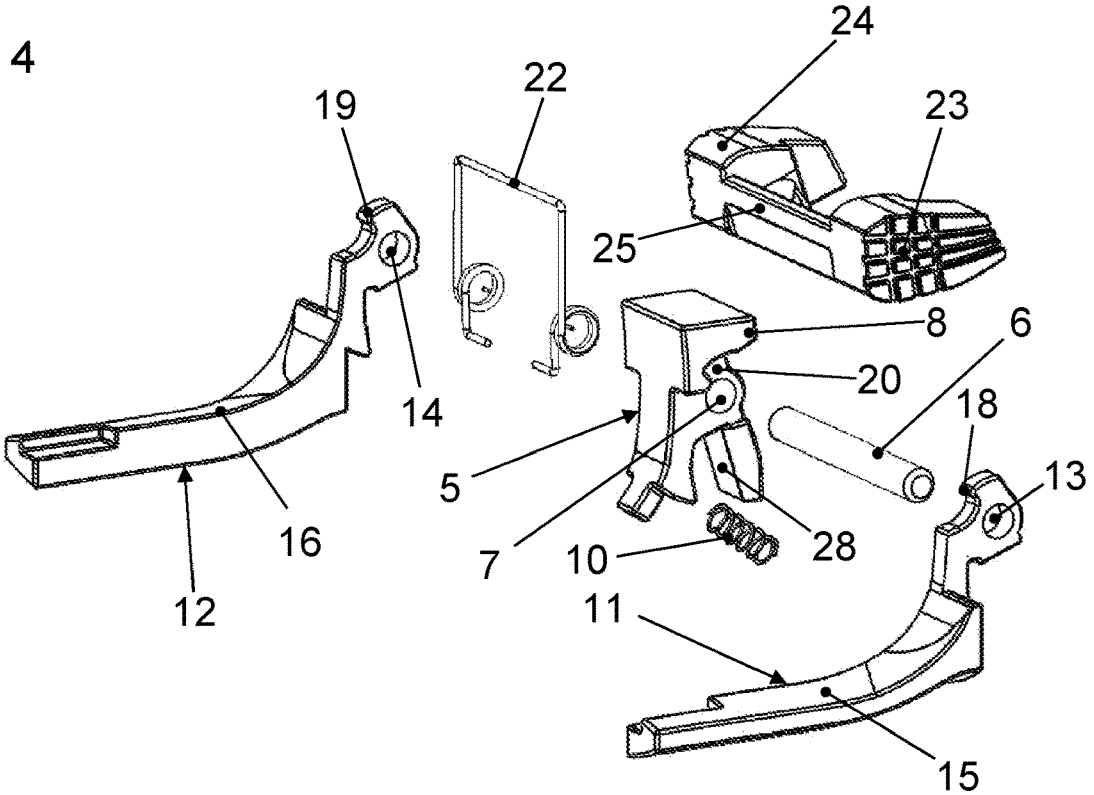
FIG. 4 is an exploded view of the retaining means and the magazine release means of the self-loading pistol according to FIG. 1.
Figure 6:
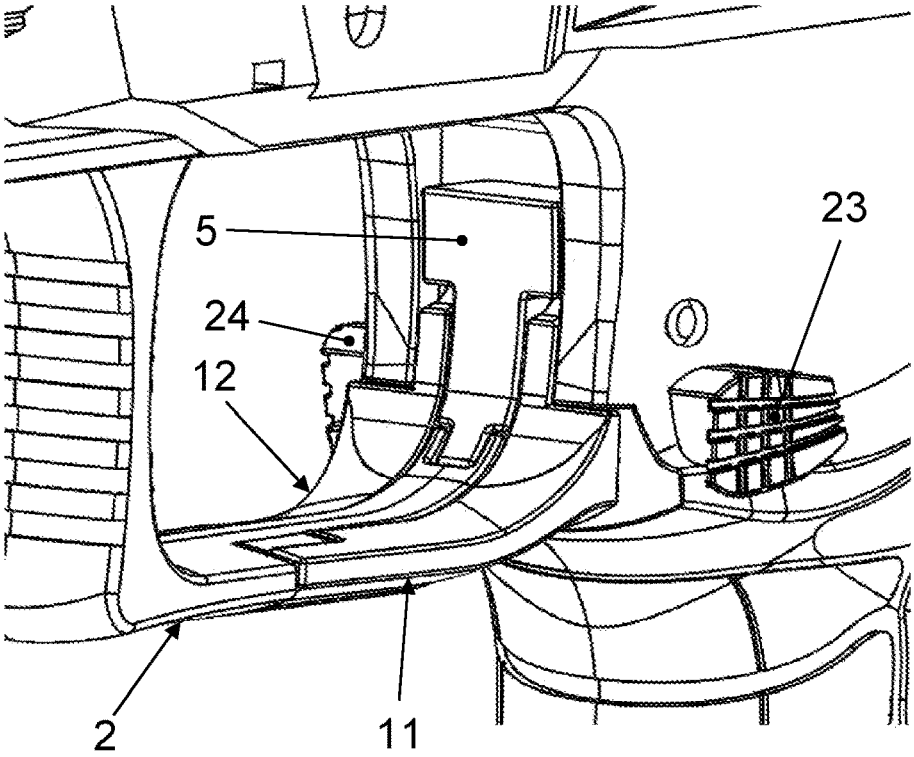
FIG. 6 is a detail of FIG. 1, which shows the retaining means and the magazine release means in the installed state in the grip piece, with the retaining means holding the magazine.
Figure 7:
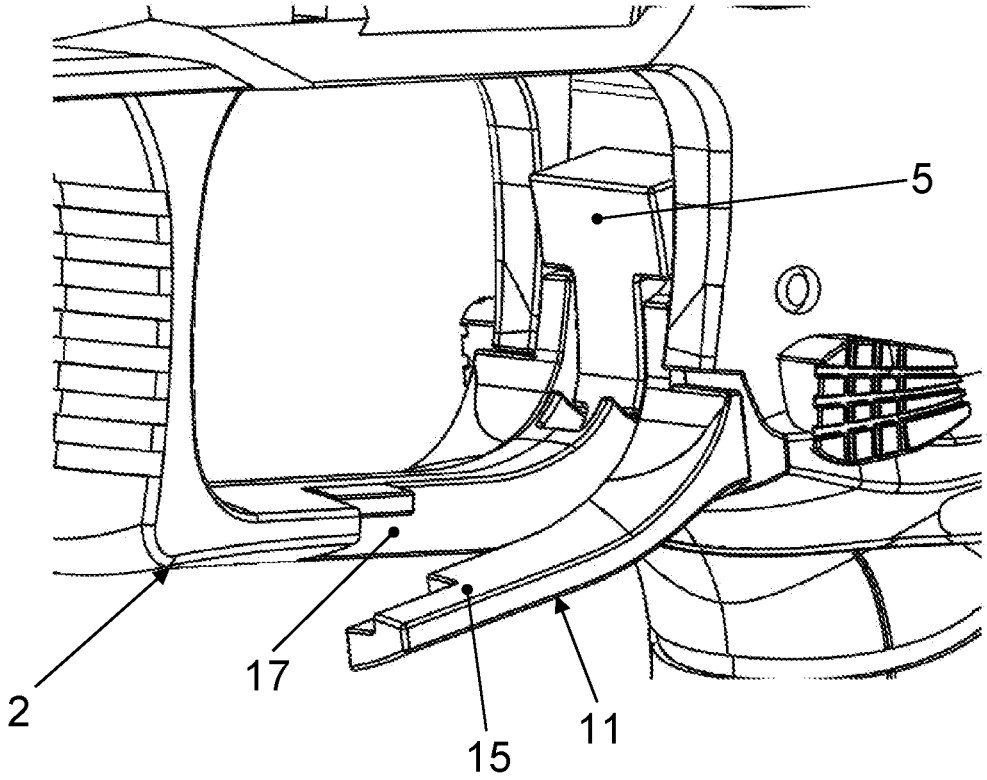
FIG. 7 is a view, which corresponds to FIG. 6 and in which the magazine is released by actuating a release lever.

Furthermore, the magazine release means comprise two release buttons 23, 24, each one of which is arranged on a side of the self-loading pistol (see FIG. 4, FIG. 5 and FIG. 6). The release buttons 23, 24 are connected to one another by means of a web 25 that extends in the transverse direction (see FIG. 4 and FIG. 12). The release buttons 23, 24 can be pushed, together with the web 25, in the transverse direction of the self-loading pistol.

Figure 12:
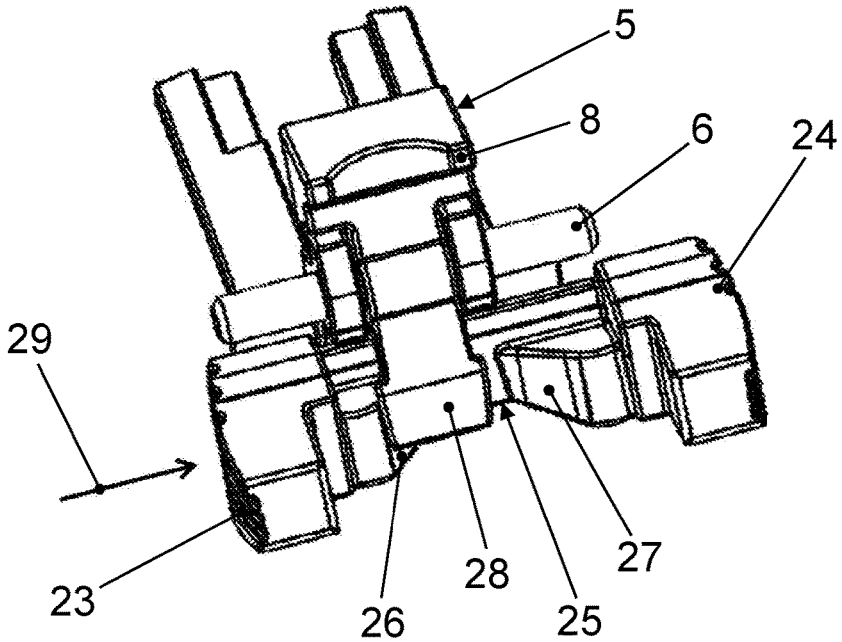
FIG. 12 is a perspective view of the retaining means and the magazine release means in the assembled state, wherein one of the release buttons is actuated.

Two outwards rising ramps 26, 27 are disposed on the rear side of the web 25 in the direction of fire (see FIG. 12). A leg 28 of the retaining means 5 rests against the rear side of the web 25 or, more specifically, on one of the ramps 26, 27 in the assembled state (see FIG. 4 and FIG. 12).

Figure 8:
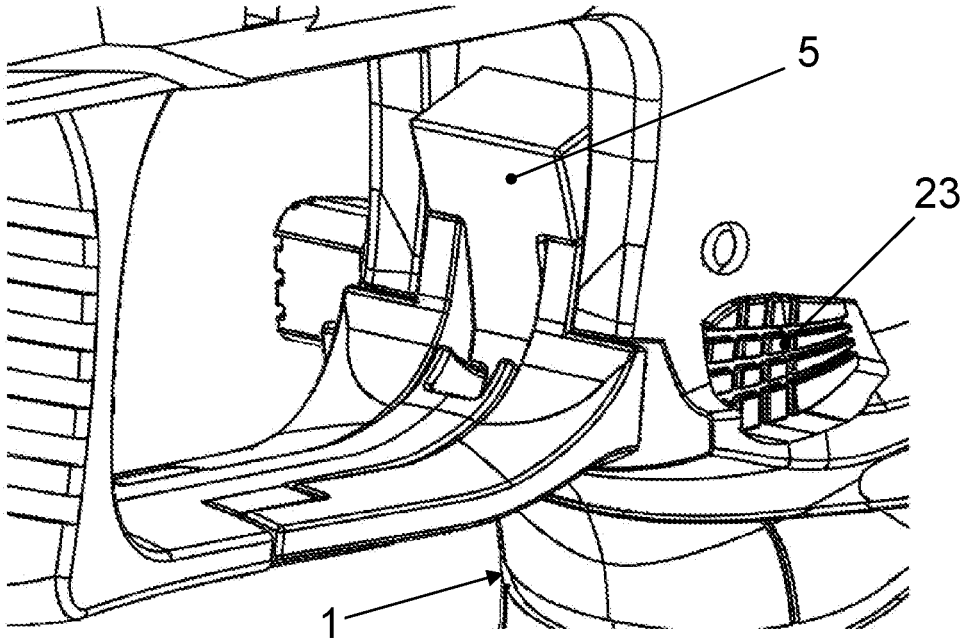
FIG. 8 is a view, which corresponds to FIG. 6 and in which the magazine is released by actuating a release button.
Figure 11:
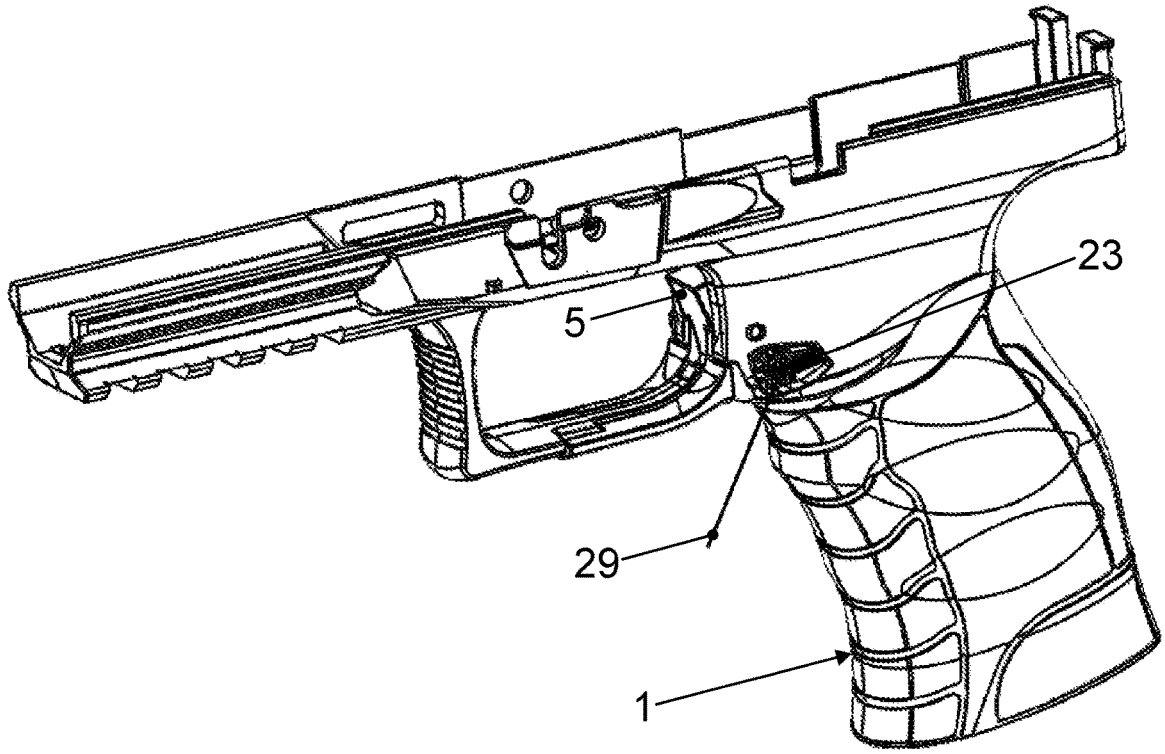
FIG. 11 is a view, which corresponds to FIG. 1 and in which the magazine is released by actuating a release button.

When the user pushes, for example, the left release button 23, in particular, with his thumb, into the grip piece 1 in accordance with the arrow 29 in FIG. 11 and FIG. 12, the left ramp 26 of the web 25 in FIG. 12 moves behind the leg 28 and pushes said leg to the rear. In this way, as shown in FIG. 8, FIG. 11 and FIG. 12, the retaining pawl 8 is pivoted out of the recess 9 of the magazine 4, so that said magazine is released and can be removed from the magazine shaft 3.

When the user releases the respective release button 23, 24, the web 25 is moved by the spring 10, acting on the retaining means 5, again into the central position, so that the corresponding release button 23, 24 is transferred back again into the home position.

The movement of the release buttons 23, 24 can take place independently of a movement of the release levers 11, 12, because in the assembled state of the magazine release means the web 25 extends beneath the release levers 11, 12 and can move freely relative to said release levers (see FIG. 5 and FIG. 10).

What is claimed is:

1. A self-loading pistol, comprising:

a magazine shaft to receive a magazine;

a retainer to hold the magazine releasably in the magazine shaft; and a magazine release to cause the retainer to release the magazine, wherein the magazine release is operable from both sides of the self-loading pistol and comprises: two release buttons arranged on different sides of the self-loading pistol, and two release levers disposed on different sides of the self-loading pistol, wherein the magazine is releasable by actuating either of the release buttons and/or by actuating either of the release levers.

2. The self-loading pistol, as claimed in claim 1, wherein the release levers can be actuated and/or moved independently of the release buttons.

3. The self-loading pistol, as claimed in claim 1, wherein either one of the release levers can be actuated and/or moved independently of the respective other release lever.

4. The self-loading pistol, as claimed in claim 3, wherein, upon actuation, either one of the release levers is pivoted about an axis that extends in a transverse direction of the self-loading pistol.

5. The self-loading pistol, as claimed in claim 3, wherein, upon actuation, either one of the release levers can be freely rotated relative to the axis.

6. The self-loading pistol, as claimed in claim 1, wherein the release buttons are rigidly connected to one another by a web that extends in a transverse direction of the self-loading pistol.

7. The self-loading pistol, as claimed in claim 6, wherein the web, connecting the release buttons comprises two ramps along which, upon actuation of either of the release buttons, a section of the retainer slides such that the magazine is released.

8. The self-loading pistol, as claimed in claim 7, wherein:

the retainer comprises a retaining pawl to engage in a recess of the magazine and, in a state extending into the recess, holds the magazine in the magazine shaft; and upon actuation of either of the release buttons, the retaining pawl is pivoted out of the magazine recess.

9. The self-loading pistol, as claimed in claim 1, wherein, upon actuation, either one of the release buttons is displaced in a transverse direction of the self-loading pistol into a grip piece of the self-loading pistol.

10. The self-loading pistol, as claimed in claim 1, wherein the retainer comprises a retaining pawl to, engage in a recess of the magazine and, in a state extending into the recess, holds the magazine in the magazine shaft.

11. The self-loading pistol, as claimed in claim 1, wherein each of the release levers has a nose, which engages in a recess of the retainer and, upon actuation of the release lever, moves the retainer such that the magazine is released.

12. The self-loading pistol, as claimed in claim 11, wherein:

the retainer comprises a retaining pawl to engage in a recess of the magazine and, in a state extending into the recess, holds the magazine in the magazine shaft; and upon actuation of either of the release levers, the retainer is moved such that the retaining pawl is pivoted out of the magazine recess.

13. The self-loading pistol, as claimed in claim 1, wherein the magazine release comprises at least one spring to transfer an actuated release lever or an actuated release button back into a home position after the magazine has been released.

* * * * *